US009126096B2

(12) United States Patent
Puelacher

(10) Patent No.: US 9,126,096 B2
(45) Date of Patent: Sep. 8, 2015

(54) SKI SKIN

(76) Inventor: Michael Puelacher, Absam (AT)

( * ) Notice: Subject to any disclaimer, the term of this patent is extended or adjusted under 35 U.S.C. 154(b) by 1678 days.

(21) Appl. No.: 13/391,678

(22) PCT Filed: Apr. 6, 2007

(86) PCT No.: PCT/AT2007/000156
§ 371 (c)(1),
(2), (4) Date: Apr. 10, 2012

(87) PCT Pub. No.: WO2008/122061
PCT Pub. Date: Oct. 16, 2008

(65) Prior Publication Data
US 2012/0189802 A1 Jul. 26, 2012

(51) Int. Cl.
*A63C 7/02* (2006.01)
*A63C 7/04* (2006.01)

(52) U.S. Cl.
CPC ..... *A63C 7/04* (2013.01)

(58) Field of Classification Search
CPC ..... A63C 7/04; A63C 7/02; A63C 7/00
USPC ..... 428/96, 95; 280/604, 809
See application file for complete search history.

(56) References Cited

U.S. PATENT DOCUMENTS

| | | | | |
|---|---|---|---|---|
| 3,980,312 | A | 9/1976 | Buttner | |
| 4,165,886 | A * | 8/1979 | Nussbaumer | 280/604 |
| 2005/0070681 | A1 | 3/2005 | Penick | |
| 2010/0239808 | A1* | 9/2010 | Schwitter | 428/96 |
| 2012/0109802 | A1* | 5/2012 | Griffin et al. | 705/35 |
| 2012/0189802 | A1 | 7/2012 | Puelacher | |

FOREIGN PATENT DOCUMENTS

| | | | | |
|---|---|---|---|---|
| CH | 134395 | A | | 7/1929 |
| CH | 700590 | B1 | * | 9/2010 |
| DE | 8605009 | UI | | 5/1986 |
| DE | 9304437 | UI | | 9/1994 |
| DE | 29501818 | UI | | 5/1995 |
| DE | 20220713 | UI | | 2/2004 |
| DE | 202012006297 | U1 | * | 11/2013 |
| EP | 1084681 | A1 | | 3/2001 |
| EP | 1992390 | A1 | * | 11/2008 |
| EP | 2047891 | A1 | * | 4/2009 |
| EP | 2131931 | A1 | | 12/2009 |
| EP | 2727635 | A1 | * | 5/2014 |
| FR | 2 259 629 | A1 | | 8/1975 |
| GB | 312813 | A | | 6/1929 |
| WO | 2007/004034 | A1 | | 1/2007 |
| WO | 2008122061 | A1 | | 10/2008 |

OTHER PUBLICATIONS

International Search Report, dated Dec. 7, 2007, from corresponding PCT application.
Neumuller, Dr. Otto-Albrecht, Rompps, Chemie-Lexikor, Band 5: PI-S, "Silicon", pp. 3855-3859.
Neumuller, Dr. Otto-Albrecht, Rompps, Chemie-Lexikor, Kleber, "Klebstoffe" pp. 2252-2254.
Neumuller, Dr. Otto-Albrecht, Rompps, Chemie-Lexikor, "Adhasion", p. 55.
Neumuller, Dr. Otto-Albrecht, Rompps, Chemie-Lexikor, "Silicium-Sauerstoff-Verbindungen", pp. 4168-4172.
Vert, Peter, "Silicone adhesives offer opportunities for high-value applications", Silicone Solutions, Adhesives and Sealants Industry, May 2004, vol. 11, No. 4, pp. 28.
Wikipedia, Pressure-sensitive adhesive, 2012, http://en.wikipedia.org/w/index.php?title=Pressure-sensitive_adhesive&oldid=499251304, Categories: Adhesives/Stationery.

* cited by examiner

*Primary Examiner* — Cheryl Juska
(74) *Attorney, Agent, or Firm* — Young & Thompson

(57) ABSTRACT

The invention relates to a ski skin, wherein a silicon compound is applied to the reverse side of the plush skin tread and adheres to the ski by van der Waals forces.

3 Claims, No Drawings

SKI SKIN

The invention relates to a ski skin which has a silicone coating on the back.

BACKGROUND OF THE INVENTION

In order to give a touring ski (ski for ascending mountains) a hold on the snow when ascending in ski touring, it is known to adhere or strap a ski skin to the running surface of the touring ski and additionally fix on the ski depending on the model. The ski skin prevents the ski from sliding backwards and at the same enables the ski to slide forwards.

The adhesive with which the ski skin is adhered to the running surface of the ski is applied to an adhesive back (usually cotton back) laminated on the rear side of the ski and usually has the property of being usable many times, i.e. multiple adhesion and release of the adhesive compound between the adhesive side of the ski skin and the running surface of the ski is possible. In order to preserve the property of multiple use, the adhesive side should be covered with a covering film after removing the ski skin from the ski.

However, the known adhesive compound with the ski is limited by the adhesive strength and adhesive duration of the adhesive which decrease with every pulling of the ski skin onto the ski and with every removal of the ski skin from the ski. It is usually possible to pull on and off 50 times and then the adhesive is unusable. In addition, the adhesive property is dependent on user behaviour since the user has to apply a covering film to the adhesive surface after removing the ski skin. If, as is usual in practice, this covering film is not applied, the desired adhesive property is shortened appreciably as a result of the contamination of the adhesive surface and the adhesive drying out.

SUMMARY OF THE INVENTION

It is therefore the object of the invention to configure a ski skin such that for all relevant temperature and snow conditions and regardless of the negligence or convenience of the user and the number of times the ski skin is pulled on and off the ski, an adhesive connection that can be released and remade at any time is made between the ski skin and the running surface of the ski, which does not suffer any loss of adhesion.

The invention solves the formulated object whereby instead of an adhesive applied to the back of the plush skin tread, a non-curing silicone compound (silicone-based coating) is applied which produces an adhesive connection ("Van der Waals binding") between the ski skin and the running surface of the ski due to so-called Van der Waals forces.

Since this connection experiences no loss of adhesion, the ski skin can be pulled on and off the running surface of the ski an unlimited number of times. Unlike an adhesive, the adhesive connection can be released without residue. It is not necessary to protect the back of the ski skin by a covering film. Hitherto the plush skin tread has been laminated with a cotton back as contact surface for the adhesive on which the adhesive is then applied. Since the silicone compound or silicone coating is applied directly to the rear side of the woven plush skin tread (sprayed, cast, adhered, injection moulded, calendared etc.), a cotton back or any other material laminated to the plush skin tread can be dispensed with.

The invention claimed is:

1. A ski skin, comprising:

a plush skin tread; and a non-curing silicone compound applied to a back side of the plush skin tread suitable to produce an adhesive connection, by Van der Waals binding, between the ski skin and a running surface of a ski.

2. The ski skin according to claim 1, wherein the plush skin tread is a woven plush skin tread, and wherein the silicone compound coating is applied directly to the woven plush skin tread.

3. The ski skin according to claim 1, wherein the silicone compound is applied directly to the back side of the plush skin tread.

* * * * *